United States Patent [19]

Thuries et al.

[11] Patent Number: 4,650,941

[45] Date of Patent: Mar. 17, 1987

[54] COMPRESSED GAS, HIGH TENSION CIRCUIT BREAKER, WITH OPERATING ENERGY ASSISTED BY THE THERMAL EFFECT OF THE ARC

[75] Inventors: Edmond Thuries, Pusignan; Michel Perret, Villeurbanne, both of France

[73] Assignee: Alsthom, Paris, France

[21] Appl. No.: 818,299

[22] Filed: Jan. 13, 1986

[30] Foreign Application Priority Data

Jan. 16, 1985 [FR] France ..... 85 00610

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 4,163,131 | 7/1979 | Perkins | 200/148 A |
| 4,219,711 | 8/1980 | McConnell | 200/148 A |
| 4,450,330 | 5/1984 | Zuckler | 200/148 A |
| 4,486,632 | 12/1984 | Niemeyer et al. | 200/148 A |

FOREIGN PATENT DOCUMENTS

| | | | |
|---|---|---|---|
| 2847221 | 10/1979 | Fed. Rep. of Germany | 200/148 A |
| 54-42979 | 3/1979 | Japan | 200/148 A |

*Primary Examiner*—Robert S. Macon

*Attorney, Agent, or Firm*—Sughrue, Mion, Zinn, Macpeak & Seas

[57] ABSTRACT

The invention relates to a compressed gas high tension circuit breaker in which the energy required for operation is assisted by the thermal effect of the arc, the circuit breaker comprising fixed main contacts and fixed arcing contacts, a moving assembly comprising moving main contacts and moving arcing contacts, a blast nozzle, and a thermal volume in which the gas pressure increases under the effect of heating due to the arc which extends between the arcing contacts when the separate, the circuit breaker including the improvement of means for responding to the pressure existing in said thermal volume (3, 35) to exert a greater force on the moving assembly (9) than the forces exerted thereon due to its resistance to movement, said means including a differential piston arrangement.

8 Claims, 5 Drawing Figures

COMPRESSED GAS, HIGH TENSION CIRCUIT BREAKER, WITH OPERATING ENERGY ASSISTED BY THE THERMAL EFFECT OF THE ARC

The present invention relates to a compressed gas high tension circuit breaker in which the operating energy is assisted by the thermal effect of the arc.

BREAKER OF THE INVENTION

Circuit breakers of this type are already known in which a thermal volume is provided whose temperature, and consequently whose pressure, increases considerably under the effect of the arc which is established at the moment the arcing contacts are separated.

On the zero crossing of the current to be interrupted the gas in the thermal volume expands and blasts the arc.

The gas blast of thermal origin is generally combined with a gas blast of mechanical origin which is obtained by virtue of the moving parts of the circuit breaker causing a piston to move relative to a cylinder.

The pressure generated by the arc in the thermal volume opposes displacement of the moving parts of the circuit breaker. In other words, although the arc is energetically and effectively blasted, this result is obtained at the expense of an additional energy requirement for moving the circuit breaker components when breaking a circuit.

Preferred embodiments of the invention provide a thermal blast circuit breaker requiring as little operating energy as possible.

German published patent specification No. 2 847 221 describes a circuit breaker having a compression chamber in which the gases heated by the arc are directed into the space lying between the outer casing of the circuit breaker and the compression chamber and are caused to exert a force on a ring which is fixed to the moving equipment.

This arangement reduces the energy required to operate the circuit breaker to some extent. However, the expansion volume available to the gases is relatively large and the pressure which can be exerted on the ring is relatively small.

Further, there is a danger in conveying hot gases to the vicinity of the outer envelope of a circuit breaker in that unwanted arcing may be provided.

Preferred circuit breakers in accordance with the invention avoid these drawbacks. The hot gas used to assist the opening operation remains confined within a relatively small volume and within components which are at the same potential.

SUMMARY OF THE INVENTION

The present invention provides a compressed gas high tension circuit breaker in which the operating energy is assisted by the thermal effect of the arc, the circuit breaker comprising fixed main contacts, fixed arcing contacts, a moving assembly comprising moving main contacts and moving arcing contacts, a gas blast nozzle, and a thermal volume in which the gas pressure increases under the heating effect of the arc which is established on separation of the arcing contacts, the circuit breaker including the improvement of a volume delimited by first and second fixed pistons, first and second cylinders belonging to said moving assembly, and an end plate which is common to both cylinders, said volume delimited by said pistons and said second cylinder being in communication with said thermal volume, and said first cylinder being maintained at the pressure extending within the remainder of the circuit breaker.

BRIEF DESCRIPTION OF THE DRAWINGS

Embodiments of the invention are described by way of example with reference to the accompanying drawings, in which.

MORE DETAILED DESCRIPTION

Figure 1:
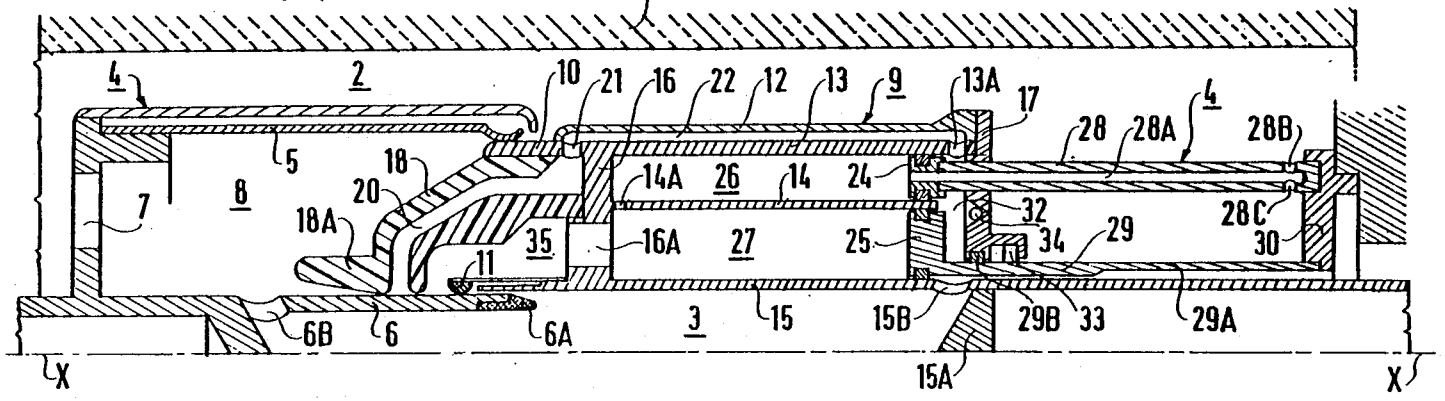
FIG. 1 is an axial section through a portion of a first embodiment of a circuit breaker in accordance with the invention, the circuit breaker being in the closed position.

In FIG. 1, reference 1 designates an envelope of electrically insulating material which encloses the active portions of a circuit breaker which is cylindrically symmetrical about a longitudinal axis XX.

The inside of the envelope is filled with a dielectric gas having a high arc-quenching power, e.g. sulfur hexafluoride, at a pressure of a few bars. Reference 2 designates the volume between the envelope 1 and the active portions of the circuit breaker, and reference 3 designates a volume surrounding the axis XX.

The circuit breaker comprises a fixed assembly 4 comprising fixed main contact fingers 5 and a tubular fixed arcing contact 6. The end of the tube has a portion 6A made of material which withstands arcing (e.g. tungsten). The fized assembly includes bores 6B and 7 for putting the volume 3 into communication with the volume 2 in order to evacuate and diffuse hot gas after an arc has been interrupted.

Reference 8 designates the annular volume lying between the fixed main contacts 5 and the fixed arcing contact 6.

The moving assembly 9 of the circuit breaker comprises a tubular moving main contact 10 and arcing contact fingers 11. These contacts are fixed to a cylindrical structure comprising a plurality of concentric tubular parts 12, 13, 14 and 15.

The tube 15 has the finger 11 fixed to one end thereof and has its other end connected to operating means (not shown). The tubes 13, 14, and 15 are interconnected and closed by an end plate 16, whereas the tubes 12 and 13 are interconnected by an end plate 17 which leaves an annular passage around the tube 15. A nozzle of insulating material 18 is fixed to the end plate 16 and has a throat-delimiting portion 18A, and when the circuit breaker is closed it comes into contact with the fixed arcing contact.

Ducts 20 made inside the nozzle, and bores through the tube 13 put the volume 3 into communication with an annular volume 22 between the tubes 12 and 13 when the tube 6 has left the nozzle.

Finally, the circuit breaker includes two fixed annular pistons 24 and 25 which are engaged respectively in the volume 26 lying between the tubes 13 and 14 and the volume 27 lying between the tubes 14 and 15.

The piston 24 is fixed to rods such as the rod 28, while the piston 26 is fixed to a tubular rod 29 which extends along the annular passage between the end plate 17 and the tube 15. The rods 28 and 29 are fixed to a common metal block 30 which is itself connected to an electricity connection point (not shown). A sealing ring 29B seals the volume 32 lying between the pistons and the end plate 17.

The volumes 22 and 32 communicate with each other via bores 13A through the tube 13.

The rods 28 have longitudinal channels 28A and transverse orifices 28B and 28C therethrough in order to put the volume 26 into communication with the volume 2.

Sliding electrical contacts 33 provide electrical contact between the end plate 17 and the tube 29.

The end plate 17 has a non-return valve 34 whose function is explained below.

Let the cross-sectional area of the annular volume 27 be designated by S1 and the cross-sectional area of the annular volume 32 be designated by S2. Wide orifices 16A put the volume 27 into communication with the volume 35 lying between the nozzle and the moving arcing contacts.

The volume 3 is reduced by a disk-shaped part 15A which is fixed to the tube 15. Holes 15B provide communication between the volume 3 and the volume 2.

Finally, holes 14A through the tube 14 allow equilibrium to be established between the pressures in the volumes 26 and 27 when the circuit breaker is engaged.

The circuit breaker operates as follows:

- in its closed position, as shown in FIG. 1, current passes through the contacts 5 and 10, the tubes 12 and 13, the end plate 17, the contacts 33, the tube 29, and the block 30;
- the circuit breaker is opened by displacing the moving assembly comprising the contacts 10 and 11, the nozzle 18, and the tubes 12 to 15 to the right (as shown in the drawing).

Figure 2:
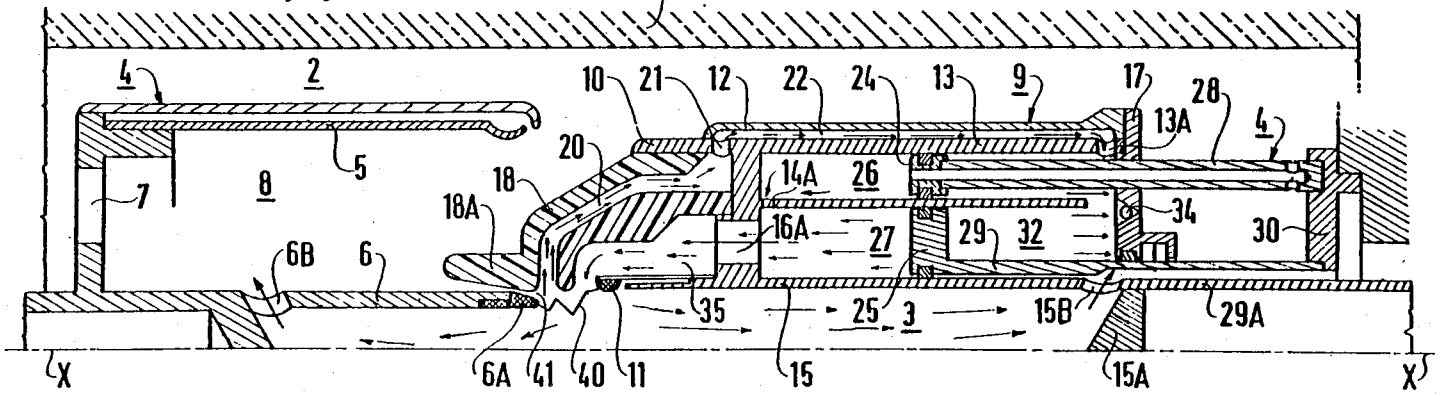
FIG. 2 is a partial axial section through the FIG. 1 circuit breaker, but in the open position.

When the main contacts separate, and before the arcing contacts 6 and 11 separate, electric current passes through the arcing contacts 6 and 11, the end plate 16, the tubes 12 and 13, the end plate 17, the contacts 33, the tube 29, and the block 30. The calibrated valve 34 opens to allow the volume 32 to fill without slowing down the movement. When the arcing contacts 6 and 11 separate, as shown in FIG. 2, an arc 40 is struck between said contacts.

The gas in the volume 35 is compressed firstly by the mechanical effect of the piston 25 and secondly because of the temperature rise due to the arc. The increased pressure established in this manner in the volume 35 is conveyed via the ducts 20 and 22 to the volume 32.

This pressure acts on the area S2 of the volume 32, which area is larger than the area S1 of the volume 27. The valve 24 closes. By virtue of the ducts 28A and the holes 28B and 28C the pressure in the volume 26 remains constant and equal to the pressure in volume 2.

As a result, the force exerted on the end plate 17 by the gas in the volume 32 is greater than the resistance to motion produced by the gas in the volume 27. In other words, the greater the energy of the arc, the greater the increase in pressure and the greater the operating energy applied to the moving assembly. This results in quicker arc extinction since the moving assembly is accelerated by the arc instead of being slowed down by the arc. After the arc has been extinguished, the hot gases escape via the holes 6B and 15B and the space 41 which opens between the nozzle 18 and the contact 6.

A thin portion 29A of the tube 29 which comes level with the hole 15 at the end of circuit breaker opening, provides additional flow volume which is sufficient for the required gas flow.

Figure 3:
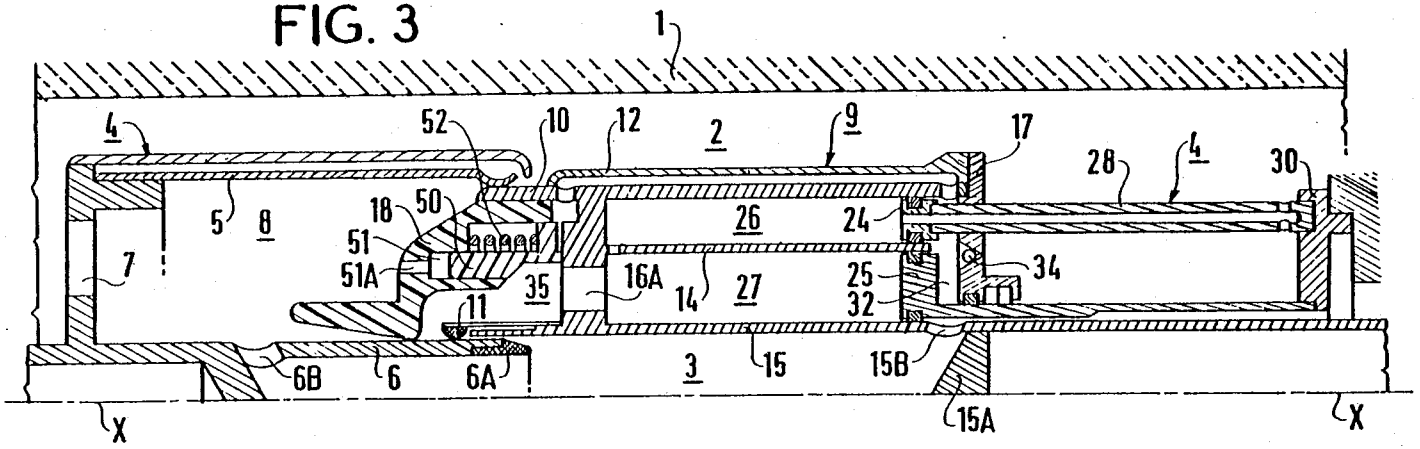
FIG. 3 is a partial axial section through a variant circuit breaker in accordance with the invention.

FIG. 3 shows a variant in which the volume 35 is no longer connected to the volume 22 via a passage through the nozzle, but rather via a non-return valve 50 made of insulating material and capable of sliding in an annular cavity 51 made in the nozzle and resiliently biased by springs such as 52.

When the pressure in the volume 35 reaches a suitable value, the valve 50 opens and thereby puts the volume 32 under pressure.

When the pressure falls, after the arc has been extinguished, the springs close the valve. The hole 51A at the bottom of the cavity serves to reduce the pressure behind the valve.

Figure 4:
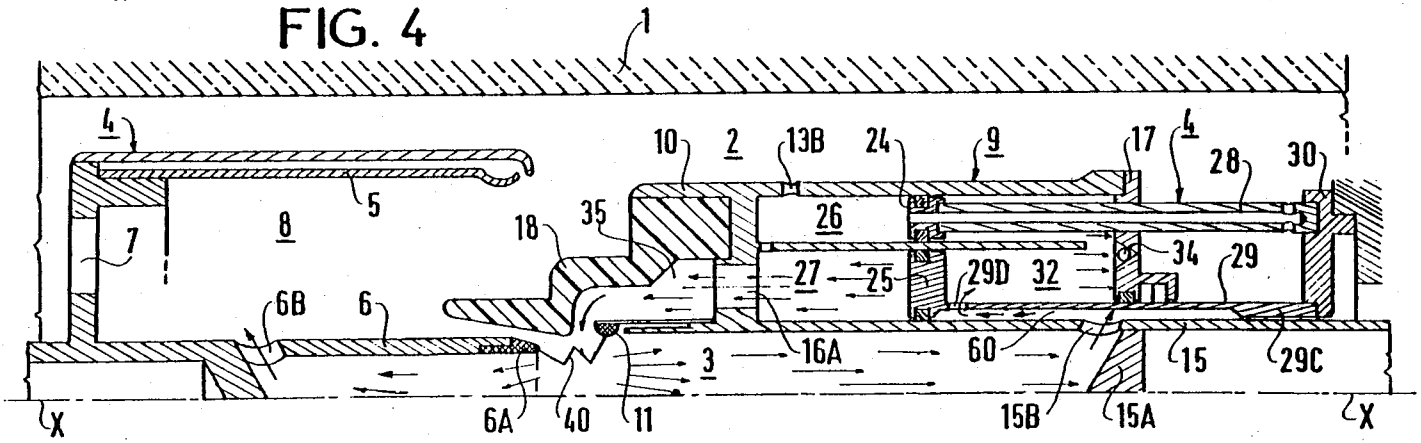
FIG. 4 is a partial axial section through another variant embodiment of the invention.

In the variant shown in FIG. 4, the volume 22 has been omitted. Pressure is conveyed to the volume 32 from the volume 3 via holes 15B, the volume 60 lying between the tubes 29 and 15 (with the gap between these tubes being increased in this case), and holes 29D made through the tube 29 close to the piston 25.

The tube 29 is thickened at 29C in order to limit the pressure losses of volume 60.

Bleed holes 13B serve to return the volume 32 to the internal pressure of the circuit breaker after the arc has been extinguished.

Figure 5:
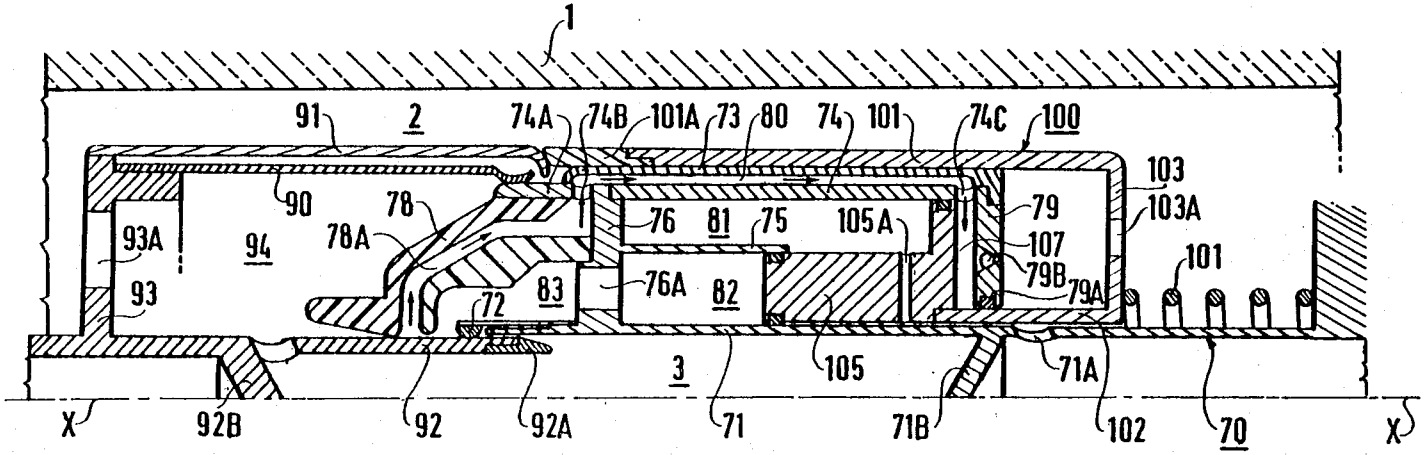
FIG. 5 is a partial axial section through yet another variant embodiment of the invention.

FIG. 5 shows a variant embodiment in which the circuit breaker includes a semi-moving assembly 100 which is resiliently biased by a spring 101 which is fixed to a fixed assembly referenced 70.

The fixed assembly is connected to an electricity connection point (not shown) and comprises a tube 71 fixed to a ring 103 against which the spring 101 is pressed. The end of the tube 71 has arcing contact fingers 72. The fixed assembly further comprises concentric tubes 73, 74, and 75. The tube 74 is extended by a portion 74A which serves as the main fixed contact. The tubes 74, 75, and 71 share a common end plate 76 having a nozzle 78 fixed thereto. The tube 73 has an end plate 79. Reference 81 designates the volume lying between the tubes 74 and 75, reference 82 designates the volume lying between the tubes 75 and 71, and reference 83 designates the volume lying between the nozzle 78 and contacts 72.

The moving assembly comprises contact fingers 90 which are protected by tube 91, together with a tubular arcing contact 92 which is terminated by a portion 92A made of material which withstands the effects of arcing. The tube 92 is connected to a circuit breaker electrical contact point (not shown) and also to a circuit breaker operating member (likewise not shown).

The tube 92, the fingers 90 and the tube 91 are connected by an annular portion 93 having large orifices 93A therethrough in order to put the volume 94 lying between the moving contacts 90 and 92 into communication with the volume 2 lying outside the moving assembly.

A disk 92B connected to the tube 92 and a disk 71B fixed to the tube 71 limit the extent of the volume 3 close to the axis of the circuit breaker.

The semi-moving assembly comprises two tubes 101 and 102 interconnected by an end plate 103. The tube 101 which is terminated by insulating portion 101A slides around the tube 73. The tube 102 slides around the tube 71, and bears a piston 105 having two portions of different cross-section, one of which slides between the tubes 74 and 75 and the other of which slides between the tubes 75 and 71.

The volume lying between the piston 105 and the end plate 79 is designated by 107. It communicates via the volume 80 between the tubes 73 and 74, via holes 74B and 74C and via at least one duct 78A through the nozzle with the region in which the arc will be formed.

The piston has channels 105A passing therethrough which put the volume 81 to the pressure existing outside the active portions of the circuit breaker via the space lying between the tubes 102 and 71, and via the holes 71A through the tube 71.

A sealing ring 79A provides sealing between the tube 102 and the end plate 79. The holes 103A through the end plate 103 allow free relative displacement between the moving assembly and the semi-moving assembly.

The end plate 79 has a non-return valve 79B arranged so that it does not open unless the pressure in the volume 107 is less than the pressure in the volume 2.

This circuit breaker operates in a manner similar to those described above.

When breaking an arc, the pressure increase in the arcing zone is transmitted to the chamber 107, thereby displacing the semi-moving assembly which is already being urged by the spring 101, and thus causes an energetic gas blast to occur in the volume 82.

When breaking a low intensity current, the energy supplied by the spring is sufficient to displace the semi-moving assembly.

We claim:

1. In a compressed gas high tension circuit breaker in which the operating energy is assisted by the thermal effect of the arc, said circuit breaker comprising an envelope housing a gas having good dielectric properties, fixed main contacts, fixed arcing contacts, a moving assembly comprising moving main contacts and moving arcing contacts, a gas blast nozzle, and means defining a thermal volume in which the gas pressure increases under the heating effect of the arc which is established on separation of the arcing contacts, all within said envelope, the improvement comprising first and second fixed pistons, first and second cylinders belonging to said moving assembly fitted about said first and second pistons, respectively, and an end plate which is common to both cylinders, said first and second fixed pistons, said first and second cylinders and said end plate delimiting a volume, means placing said volume in communication with said thermal volume, and means for maintaining said first cylinder at the pressure extending within the the circuit breaker envelope.

2. A circuit breaker according to claim 1, wherein the second cylinder opens out into the thermal volume.

3. A circuit breaker according to claim 1, wherein said means placing said volume delimited by said first and second pistons into communication with said thermal volume comprises at least one other volume which communicates with a duct through the nozzle and opens out in the vicinity of said thermal volume.

4. A circuit breaker according to claim 1, wherein said means placing said volume delimited by said first and second pistons into communication with said thermal volume comprises a duct closed by a non-return valve that opens when the pressure in said thermal volume reaches a given value.

5. A circuit breaker according to claim 3, wherein said cylinders are annular in section and concentric, said pistons have piston rods with at least one rod of said first and second pistons being hollow and placing the interior of said cylinder at the pressure extending inside the circuit breaker envelope, and the other piston rod being a tube slidably movable in a sealed manner in an opening through said end plate.

6. A circuit breaker according to claim 5, wherein one of the cylinders is a tube having said moving arcing contacts at one end thereof, and a circuit breaker operating member is connected at the other end of said tube.

7. A circuit breaker according to claim 6, wherein said means for placing said volume delimited by said first and second pistons into communication with said thermal volume comprises holes through said tube having the moving arcing contacts thereon, and holes through said hollow piston rod.

8. In a pressurized gas high tension circuit breaker using thermal gas blast, said circuit breaker comprising a fixed assembly having fixed main contacts and fixed arcing contacts, a moving assembly comprising moving main contacts and moving arcing contacts operatively engaging said fixed main contacts and said fixed arcing contacts, respectively, a blast nozzle, and means defining a thermal volume in which the gas pressure increases due to heating from the arc which is struck when the arcing contacts separate, the improvement comprising a semi-moving assembly connected to the fixed assembly by resilient means, said semi-moving assembly comprising a piston defining, together with an end plate fixed to the fixed assembly, a chamber, means associated with said chamber for putting said chamber into communication with the arcing zone, said piston having two different section areas on a side remote from said chamber, and means for subjecting one of said section areas to a pressure equal to that extending inside the chamber, and the other section area subjected to a lesser pressure, whereby; displacement of said piston directs gas into the arcing zone.

* * * * *